US011273667B2

(12) United States Patent
Busch

(10) Patent No.: US 11,273,667 B2
(45) Date of Patent: Mar. 15, 2022

(54) HOME REPAIR AND PAINT STORAGE KIT

(71) Applicant: Warren Busch, Ok Falls (CA)

(72) Inventor: Warren Busch, Ok Falls (CA)

( * ) Notice: Subject to any disclaimer, the term of this patent is extended or adjusted under 35 U.S.C. 154(b) by 0 days.

(21) Appl. No.: 17/106,012

(22) Filed: Nov. 27, 2020

(65) Prior Publication Data

US 2021/0078360 A1 Mar. 18, 2021

Related U.S. Application Data

(63) Continuation-in-part of application No. 16/276,267, filed on Feb. 14, 2019, now abandoned.

(51) Int. Cl.
*B44D 3/12* (2006.01)
*B25H 3/02* (2006.01)
*B44D 3/04* (2006.01)

(52) U.S. Cl.
CPC ..... *B44D 3/122* (2013.01); *B25H 3/022* (2013.01); *B44D 3/04* (2013.01); *B44D 3/125* (2013.01)

(58) Field of Classification Search
CPC ..... A46B 17/06; B25H 3/02; B25H 3/022; B44D 3/00; B44D 3/006; B44D 3/02; B44D 3/04; B44D 3/12; B44D 3/121; B44D 3/126; B44D 3/127; B44D 3/14; B44D 3/122; B44D 3/125; B65D 1/02; B65D 25/04; B65D 25/16; B65D 25/28; B65D 25/2841; B65D 43/16; B65D 55/02; B65D 85/28; B65D 85/54; B65D 85/70
USPC ..... 206/1.7–1.9, 372–373
See application file for complete search history.

(56) References Cited

U.S. PATENT DOCUMENTS 1,901,861 A * 3/1933 Baker ..... B44D 3/04 312/231
1,950,203 A * 3/1934 Wilson ..... B65D 5/5038 206/1.8
3,252,613 A 5/1966 McGrath
3,278,007 A * 10/1966 Weber ..... B44D 3/04 206/1.8
4,129,346 A 12/1978 Hofman
4,480,744 A 11/1984 Blackmon
4,852,930 A * 8/1989 Agee ..... A47F 5/0807 206/373
4,938,355 A * 7/1990 Rocco ..... B44D 3/121 206/372
6,619,474 B2 9/2003 Montgomery
7,563,098 B2 * 7/2009 Whitman ..... G09B 11/10 434/98
8,328,013 B2 12/2012 Stevens
8,636,145 B1 1/2014 Toleski
10,286,543 B2 * 5/2019 Haun ..... B25H 3/022

(Continued)

FOREIGN PATENT DOCUMENTS

CA 1254860 A 5/1989
CA 2585769 A1 5/2006
CN 203637437 U 6/2014

*Primary Examiner* — Bryon P Gehman
(74) *Attorney, Agent, or Firm* — Runyan Law; Charles Runyan

(57) ABSTRACT

The home repair system includes a storage container having internal compartmental divisions, the storage container includes a hinged top cover, a bottom, four walls, internal organizers, a handle, a hinge, a lock. The storage container provides organized secured storage of a minor home repair kit including hand tools and repair materials for in-the-field or out-of-the-workshop use.

19 Claims, 5 Drawing Sheets

(56) References Cited

U.S. PATENT DOCUMENTS

| | | | | |
|---|---|---|---|---|
| 2009/0314674 | A1* | 12/2009 | Sauerheber | B25H 3/021 206/373 |
| 2010/0108685 | A1 | 5/2010 | Mills, II | |
| 2014/0374279 | A1* | 12/2014 | Bechtel | B44D 3/04 206/1.7 |

* cited by examiner

HOME REPAIR AND PAINT STORAGE KIT

CROSS-REFERENCE TO RELATED APPLICATION(S)

The present application is a Continuation-in-Part application that relates to and claims priority to U.S. Non-Provisional application Ser. No. 16/276,267, filed on Feb. 14, 2019, which is a Continuation-in-Part application that relates to and claims priority to U.S. Non-Provisional application Ser. No. 15/354,127 filed Nov. 17, 2016, abandoned of which all are incorporated by reference in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

FIELD OF THE INVENTION

The present invention relates generally to the field of home repair and more specifically relates to a home repair kit.

DESCRIPTION OF RELATED ART

Many people live and work in residential and commercial buildings. Often times, when moving furniture and the like walls get scraped and damaged requiring the need for a minor repair. Generally making these minor repairs are quite time consuming and may require multiple trips to the hardware store. This is inefficient and leads to extended repair time which is not desirable.

U.S. Pat. No. 2010/0108685 to Roger Kent Mills II relates to a paint pal assembly. The described paint pal assembly includes an oversized inner paint pan, an organizer tool tray for storing tools, and a storage container with an airtight sealed lid. The container is adapted and dimensioned to store the inner paint tray and the organizer tool tray therein. The organizer tool tray has a plurality of compartments for storing several brushes and a specific compartment designed to store the paint roller. The inner paint tray is larger than the conventional paint tray and has legs which allow the pan to sit level on a flat surface. The inner tray is tapered and walled. The assembly further comprises specially designed ergonomic paint brushes.

BRIEF SUMMARY OF THE INVENTION

In view of the foregoing disadvantages inherent in the known home repair means art, the present disclosure provides a novel home repair system. The general purpose of the present disclosure, which will be described subsequently in greater detail, is to provide a home repair system.

A home repair system is disclosed herein, the home repair system comprising: a storage container having internal compartmental divisions; the storage container having a hinged top cover, a bottom, four side walls, at least one divider wall, an internal organizer, a handle, at least one hinge, at least one lock, at least one hand tool, and contained repair materials.

A home repair system is disclosed in this document. The system conveniently assembles the necessary tools and supplies and in some cases instructions to carry out the repairs, which are usually minor home repairs. Having a self-contained kit removes some of the hesitancy an inexperienced repair person might feel about undertaking these repairs themselves.

In some embodiments, the system includes a storage container with dividers to contain and organize the tools and repair materials. The storage container has paint storage receptacles for receiving mixed paint, such as house paint for a particular wall or area of a house or apartment. The system also has syringes that in some cases are useful for depositing the house paint into individual storage receptacles. In some cases, the system has labels for recording pertinent information about the house paint, and the receptacles have areas, or dedicated areas, to receive those labels.

In some classes of embodiments, the system includes tool storage positions that are customized to the tool in question. In these or other embodiments, the storage container lid is arranged so that when closed, it automatically closes any open lids on the paint storage receptacles.

Useful tools include the following: hammers, putty knives, razor knives, jam saws, paint rollers, paint trays, variously sized vials with or without pour caps, syringes, paint containers, trays, mess trays, sponges, paint brushes, and bottles, such as water bottles.

Useful materials include the following: putty for patching, wood glues, screws, nails, tape, painter's tape, drywall tape, patches, mesh patches, stir sticks, and adhesive labels.

In some embodiments, the storage container is of a convenient size, such as having outside dimensions of 19½ inches by 12 inches by 5½ inches. The storage containers can be made from a variety of materials including pine.

The system can be used by storing an amount of the paint in a labeled paint receptacle, which indicates where the paint has been used. A system syringe can facilitate filling the paint receptacles with paint. Later when a touch up is needed, the system transports easily to the repair site and the necessary wall patching and filling materials are there to repair the wall and then paint the repair.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a home repair system, constructed and operative according to the teachings of the present disclosure.

DETAILED DESCRIPTION

Figure 1:
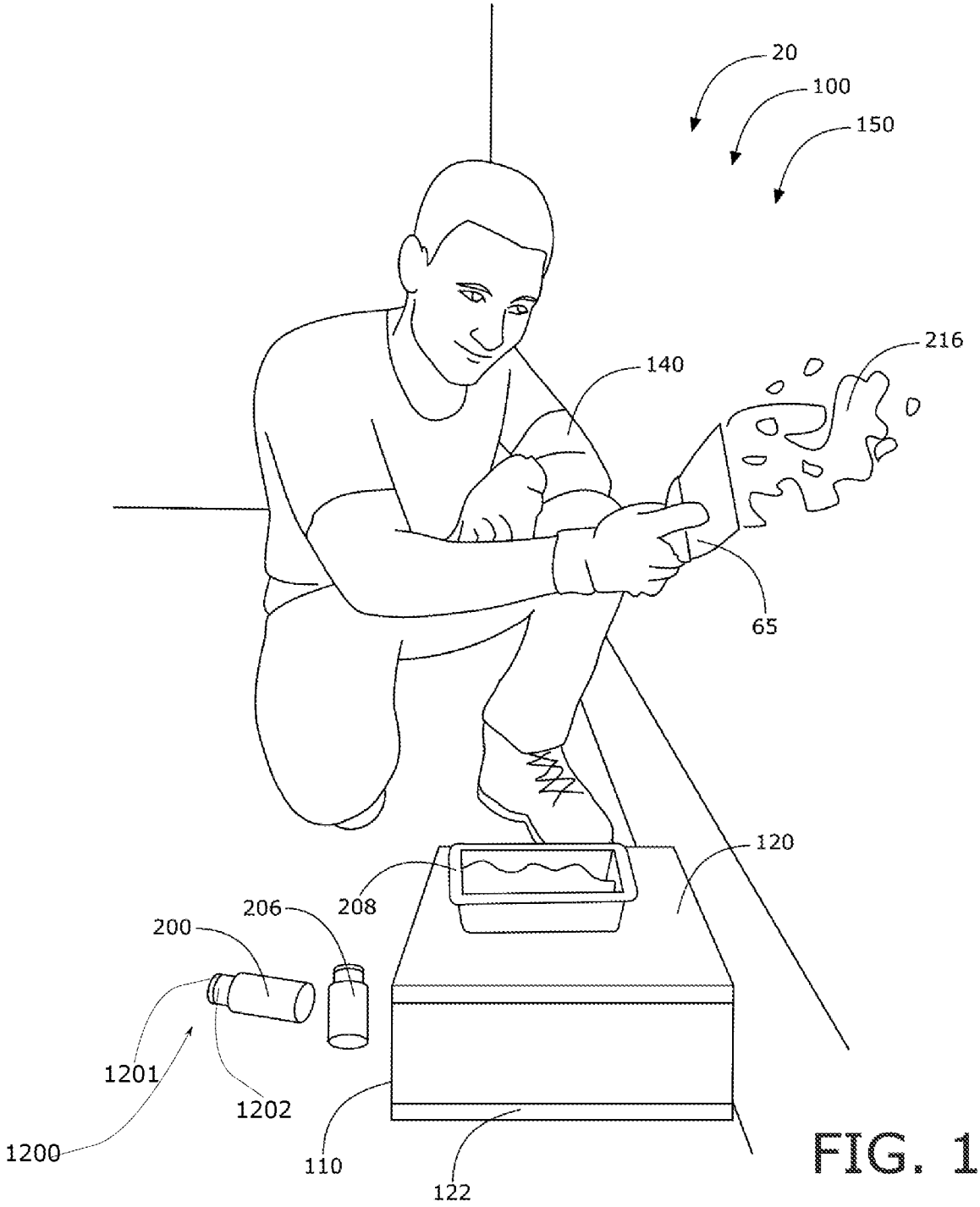
FIG. 1 is a perspective view of the home repair system during an 'in-use' condition, according to an embodiment of the disclosure.
Figure 2:
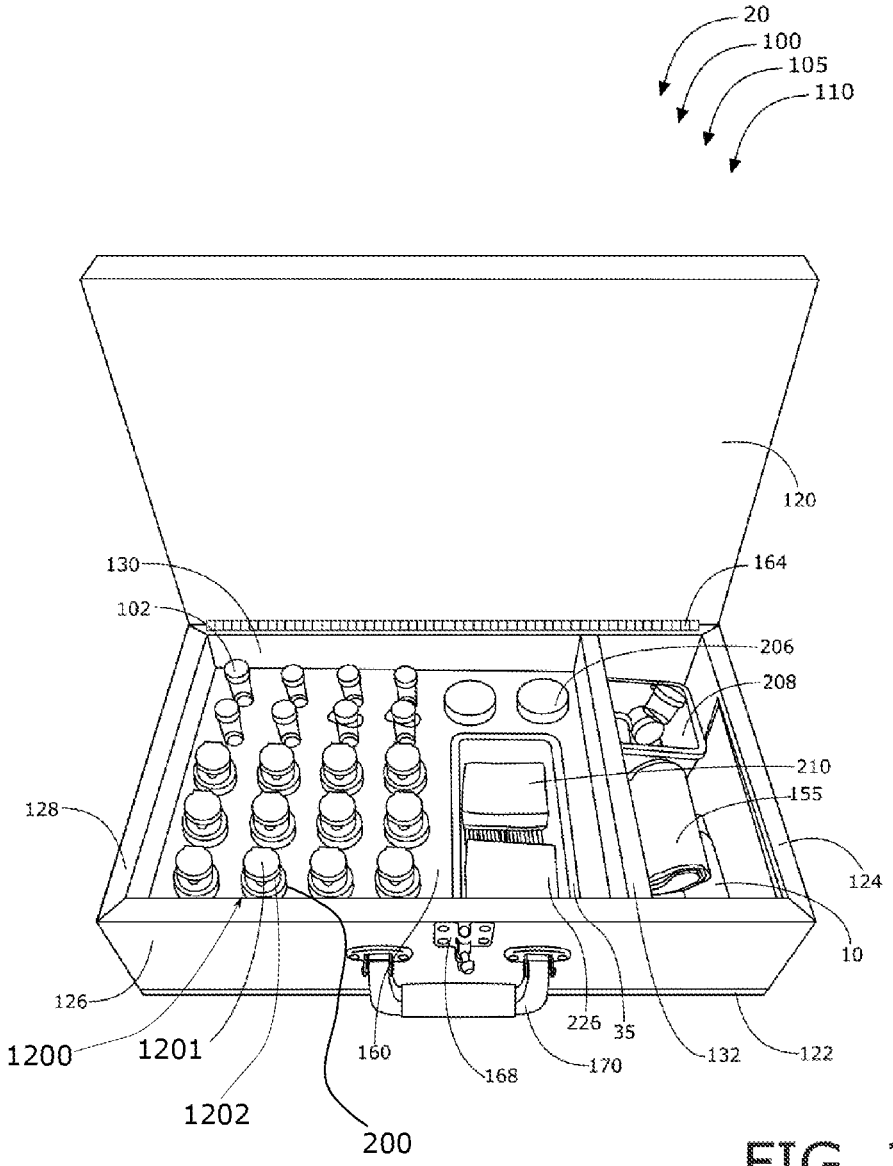
FIG. 2 is a perspective view of the home repair system of FIG. 1, according to an embodiment of the present disclosure.
Figure 3:
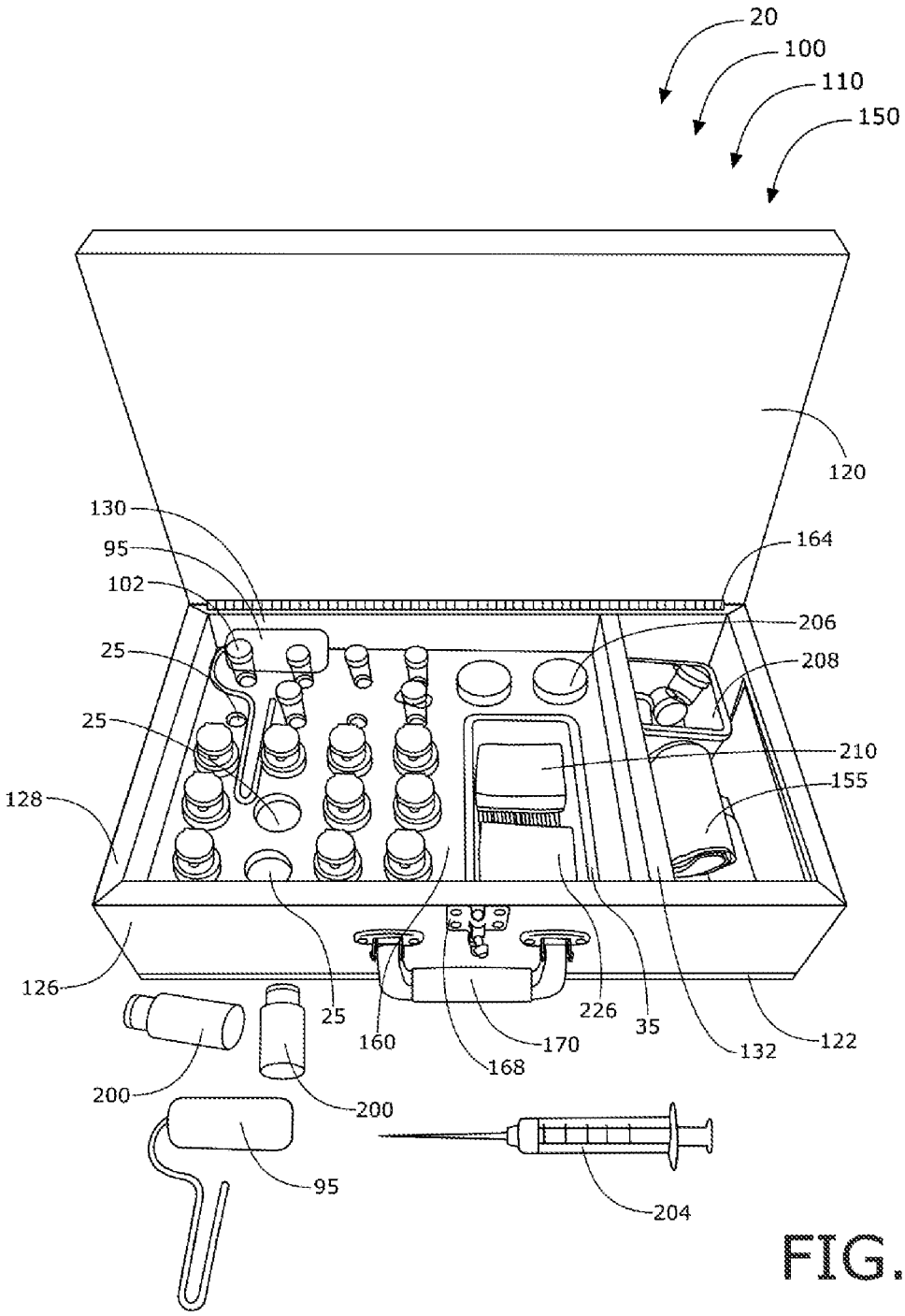
FIG. 3 is a front view of the home repair system of FIG. 1, according to an embodiment of the present disclosure.
Figure 4:
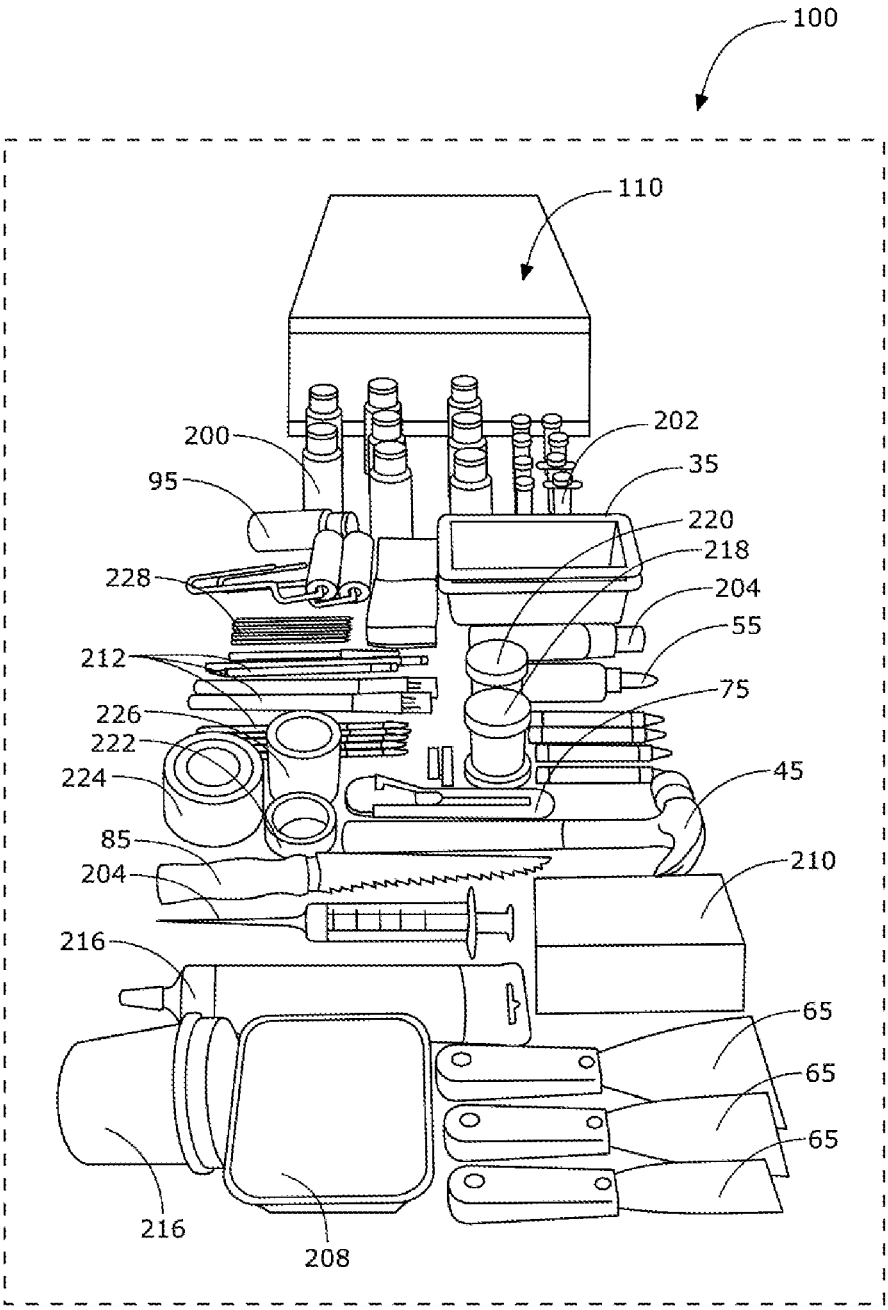
FIG. 4 shows a kit of the home repair system of FIG. 1, according to an embodiment of the present disclosure.

As discussed above, embodiments of the present disclosure relate to a home repair and more particularly to a home repair system, entitled 'SMART JOB', as used to improve the ease and convenience of repairs.

Generally speaking, in preferred embodiments, the invention comprises a solid pine box that is 19½ inches long by 12 inches wide by 5½ inches deep. It has a ⅝-inch-thick by 19½ inches long by 12-inch-wide base that is glued to be watertight to the side walls. The walls are ⅝-inch-thick solid pine with mitered and glued corners and are 4⅛ inches in height with an inside perimeter of 18 inches by 11 inches. It has a 19½ inches by 12 inches by ⅝-inch-thick top cover hinged with a brass piano hinge having a fixed stop so that the top cover can rest in an open position. It has a brass handle for carrying. It has a latch/lock for holding the top cover in a closed position. When locked in the closed position the top cover forms a friction fit holding the components within the box in a sealed and organized manner. As well when the top cover is closed it snaps all the caps of the storage vials shut. In some versions, the container is a molded shell.

Within the box there are preferably two compartments; the first compartment 13¾ inches long by 11 inches wide by 4⅛ inches deep and holds touch up vials, paint brushes, paint rollers small paint trays, putty crayons, nails, screws, syringes, sponges, drywall tape and mesh. The compartment also has a storage organizer that is customized to hold all the components in an organized friction fit configuration. A second compartment, measuring 11 inches long by 4 inches wide and 4⅛ inches deep, is designed to hold tools, and components that are not easily organized. When the box is closed and locked all the necessary items commonly used for minor home repair can be safely secured and transported. Having all of the necessary components for the minor repair conveniently located in one kit provides those who are inexperienced with such minor repairs the confidence to attempt the repairs themselves.

As such, the present invention comprises a kit; the kit including a syringe (such as a large syringe or a 1.5-ounce syringe) for extracting mixed paint from a paint can (such as a gallon paint can) so that it can be stored in a storage vial for future touch up. An adhesive label containing for example a room number, date, paint code, paint type, paint manufacture and such is provided for storing paint for future touch up repairs and reference. Further, an assortment of vials and labels may be provided for each room in the house or building. For minor dents and holes, a spackle compound is also provided. The spackle repair compound having a built-in sealer is used to reduce repair time and cost. In some embodiments, empty paint containers have a label for recording the age or date, color (or color code), finish, of the paint and for recording which room the paint has been used in. Alternatively, the empty paint containers have a space reserved for mounting such a label. In some embodiments, the label includes an indication of where the paint was purchased, the type of paint (eggshell, flat, semigloss, etc.). In some embodiments, one or more syringes are adapted to deposit paint in a storage vial or on the article to be painted.

In some embodiments, the kit contains vials, such as pourable paint vials or touch of paint vials, paint trays, one or more syringe is (in some cases of different volumes), sealed water bottles, paint rollers, paint stir sticks, sponge pads, sanding blocks, scrub pads, glue (white or cyanoacrylate)), and paint brushes. In these or other embodiments, as a kit contains putty knives, sanding blocks, a hammer (for instance 8-ounce), the utility knife a drywall saw, a nail punch (such as a find tip nail punch) putty pencils, drywall screws (in some cases of different lengths and in some cases contained in a vial), nails (in some cases different lengths, galvanized, and in some cases contained in a vial), pencils, pens, fiber mesh tape (sheets or rolls), drywall tape, painter's tape, white silicone (interior and exterior), patch and primer wall putty, standard wall putty (spackle), as well as other components known by those of ordinary skill in the art to be useful for performing home repairs or minor home repairs.

Referring now more specifically to the drawings by numerals of reference, there is shown in FIGS. 1-4, various views of a home repair system 100. FIG. 1 shows a home repair system 100 during an 'in-use' condition 150, according to an embodiment of the present disclosure. Here, the home repair system 100 may be beneficial for use by a user 140 to provide a portable minor home repair kit 105. As illustrated, the home repair system 100 may include a storage container 110 having internal compartmental divisions; the storage container 110 having a hinged top cover 120, a bottom 122, four side walls (124, 126, 128, 130), at least one divider wall 132, an internal organizer 160, a handle 170, at least one hinge 164, at least one lock 168, at least one hand tool 10, and contained repair materials 20; wherein the home repair system 100 comprises the storage container 110. Hand tools can be selected from a hammer, a putty knife, a razor knife, a jam saw, paint rollers, paint trays, 2-ounce vials with pour caps, 1-ounce vials, syringes, 3-ounce paint containers, mess trays, sponges, paint brushes, and water bottles. Repair materials can be selected from putty for patching, a wood glue, screws, nails, painter's tape, drywall tape, mesh patches, stir sticks, and adhesive labels.

The storage container 110, is configured with internal compartmental divisions to organize a minor repair kit 105. The storage container 110, is defined by a bottom 122, four sides (124, 126, 128, 130), and a hinged top cover 120, wherein the hinged top cover 120, is rotatably related to the storage container 110, via at least one hinge 164, such that the storage container 110, is able to be opened and closed as desired.

The storage container 110 having internal compartmental divisions is interiorly defined by at least one divider wall 132, and an internal organizer 134; accordingly, at least one divider wall 132 and an internal organizer 134 are useful for separably storing at least one hand tool 10, and contained repair materials 20. In some embodiments, internal organizer 134 is useful for separably storing only one type of hand tool 10. In some embodiments, internal organizer 134 is useful for separably storing only one type of repair materials 20. In some embodiments, internal organizer 134 is useful for separably storing only one type of paint storage receptacle. Some embodiments contain more than one internal hand compartment or compartmental division with each one structured and arranged for receiving only one hand tool discussed above. Some embodiments contain more than one internal repair material compartment or compartmental division with each structured and arranged for receiving only one of a plurality of repair materials. Some embodiments contain more than one internal paint storage receptacle compartmental or compartmental division with each structured and arranged for receiving only one of a plurality of paint storage receptacles.

A handle 170, is affixed to the storage container 110, such that the storage container 110, is able to be carried between locations; the storage container 110 includes at least one lock 168, allowing the storage container 110 to be locked as desired for security, and so that the storage container 110, provides organized secured storage of a minor home repair kit 105, at least one hand tool 10, and contained repair materials 20, for remote use. In some embodiments, the home repair kit 105 provides tools and repair materials for minor repairs of the home.

Further, in some embodiments, the storage container 110, comprises a box (pine or other materials, such as a molded shell, may be used) with outside dimensions of 19½ inches by 12 inches by 5½ inches therefore having a bottom 122, measuring 19½ inches by 12 inches by ⅝ inch thick. The storage container 110, includes a first side wall 124, measuring ⅝ inch thick by 4⅛ inches high, a second side wall 126, measuring ⅝ inch thick by 4⅛ inches high, a third side wall 128, measuring ⅝ inch thick by 4⅛ inches high and a fourth sidewall 130, measuring ⅝ inch thick by 4⅛ inches high. Other dimensions may be used. In some embodiments, the storage container 110, comprises a box with outside dimensions of exactly 19½ inches by 12 inches by 5½ inches therefore having a bottom 122, measuring exactly 19½ inches by 12 inches by ⅝ inch thick.

The hinged top cover 120, of the storage container 110, measures 19½ inches by 12 inches by ⅝ inch thick and the hinged top cover 120 and includes at least one hinge 164, preferably comprising a piano hinge. The storage container 110 also includes a brass handle 170. In some embodiment, the hinged top cover 120 measures exactly 19½ inches×12 inches×⅝ thick The storage container 110, having internal compartmental divisions, includes at least one divider wall 132, measuring ⅝ inch thick by 4⅛ inches high and is configured to have an internal organizer 160 for receiving paint storage receptacles 25. The paint storage receptacles 25, comprise receivers and the compartmental divisions include a plastic internal organizer 160.

Relationally speaking, the at least one divider wall 132, is orientated parallel to the first sidewall 124, and third sidewall 128, and perpendicular to a second the sidewall 126, and fourth a sidewall 130, the internal organizer 160, comprises receivers; the receivers are comprised of cylindrical and 3-d rectangular volumes.

According to one embodiment, the home repair system 100 may be arranged as a kit 105. In particular, the home repair system 100 may further include a set of instructions 155. The instructions 155 may detail functional relationships in relation to the structure of the home repair system 100 (such that the home repair system 100 can be used, maintained, or the like, in a preferred manner). Home repair system comprises: a storage container 110, having internal compartmental divisions the storage container 110 includes, a hinged top cover 120, a bottom 122, four side walls (124, 126, 128, 130), at least one divider wall 132, an internal organizer 160, a handle 170, at least one hinge 164, at least one lock 168, two paint trays 35, including an upper tray and a lower tray, at least one hand tool 10, contained repair materials 20, and a set of user instructions 107. The storage container 110 provides organized secured storage of a minor home repair kit 105, at least one hand tool 10, and contained repair materials 20, for remote use.

Hand tools in kit 105 in storage container 110 preferably comprise: a hammer 45, a wood glue 55, a putty knife 65, a razor knife 75, a jam saw 85, paint rollers 95, paint trays 35 (such as two or more paint trays), including an upper tray and a lower tray, 2-ounce vials 200 with pour caps 1200, 1-ounce vials 202, syringes 204, 3-ounce paint containers 206, mess trays 208, sponges 210, paint brushes 212 and a water bottle 214. In some versions, pour caps 1200 are snap-close lids that have a bottom portion 1202 that interacts with the paint storage containers and an upper portion 1201 connected, such as hinged, to the bottom portion 1202 such that the upper portion 1201 snaps into or onto the lower portion 1202 to provide a leak tight seal between the bottom portion 1202 and the top portion 1201.

Repair materials 20 of kit 105 comprise: putty for patching 216, wood glue 55, plugs for hanging pictures, white silicone, poly-filler for large holes, screws 218, nails 220, painter's tape 222, drywall tape 224, mesh patches 226, stir sticks 228 and adhesive labels 228. Other materials and hand tools may be included. In some versions, screws and nails and other small items or materials are optionally stored in a vial. In some embodiments, the paint containers contain wall paint or other decorative paint, but not artists paint.

Figure 5:
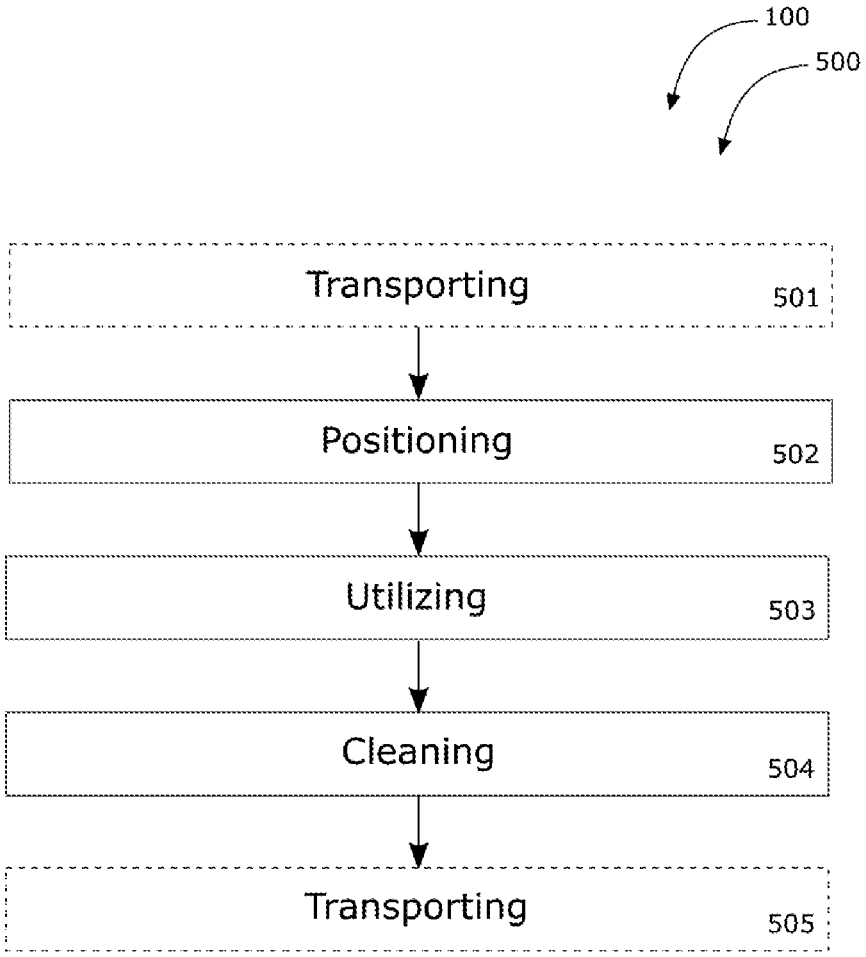
FIG. 5 is a flow diagram illustrating a method of use for the home repair system, according to an embodiment of the present disclosure.

FIG. 5 is a flow diagram illustrating a method 500 for home repairs, according to an embodiment of the present disclosure. In particular, the method 500 for minor home repair may include one or more components or features of the home repair system 100 as described above. As illustrated, the method 500 for using minor home repair may include the steps of: step one 501, transporting the system from a storage area to a work location; step two 502, positioning the kit for convenient access; step three 503, utilizing at least one hand tool 10, and contained repair materials 20, of kit 105, for needed repairs; step four 504, cleaning and returning tools and materials to storage container; step five 505, transporting kit back to storage area.

It should be noted that steps one 501, and step five 505, are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for minor home repair system (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed:

1. A kit comprising:
a storage container having
a top cover;
a bottom;
four side walls extending up from the bottom with the top cover rotatably connected to one of the side walls;
paint storage containers each having a snap-close liquid-tight lid;
an internal paint organizer with openings to receive the paint storage containers;
an internal tool container;
and
an internal repair material container,
wherein the internal tool container stores a group of painting, cutting, naildriving, and screwdriving hand tools,
wherein the internal repair material container stores drywall, wood, and paint repair material,
and
wherein the paint storage containers are taller than the vertical distance between the top cover and the bottom of the internal paint organizer such that closing the top cover snaps the liquid-tight lids closed to prevent paint leakage.

2. The kit of claim 1 wherein members of the group include:
a putty knife,
a razor knife,
a paint roller,
two paint trays,
or
paint brushes.

3. The kit of claim 2 wherein members of the group further include:
2-ounce vials with pour caps,
1-ounce vials,
syringes,
or
3-ounce paint containers.

4. The kit of claim 3 wherein members of the group further include:
a hammer,
a jam saw,
a screw driver,
or
an adjustable wrench.

5. The kit of claim 4 wherein the repair materials comprise:
putty for patching,
painter's tape,
stir sticks,
or
adhesive labels.

6. The kit of claim 5 wherein the repair materials further comprise:
a wood glue,
screws,
nails,
drywall tape,
or
mesh patches.

7. The kit of claim 6 wherein the stored hand tools and repair materials are adapted for making the repairs in the field.

8. The kit of claim 3 wherein the repair materials comprise:
putty for patching,
painter's tape,
stir sticks,
or
adhesive labels.

9. The kit of claim 8 wherein the repair materials further comprise:
a wood glue,
screws,
nails,
drywall tape,
or
mesh patches.

10. The kit of claim 2 wherein the repair materials comprise:
putty for patching,
painter's tape,
stir sticks,
or
adhesive labels.

11. The kit of claim 10 wherein the repair materials further comprise:
a wood glue,
screws,
nails,
drywall tape,
or
mesh patches.

12. The kit of claim 1 wherein the repair materials comprise:
putty for patching,
painter's tape,
stir sticks,
or
adhesive labels.

13. The kit of claim 12 wherein the repair materials further comprise:
a wood glue,
screws,
nails,
drywall tape,
or
mesh patches.

14. The kit of claim 2 wherein members of the group further include:
a hammer,
a jam saw,
a screwdriver,
and
an adjustable wrench.

15. The kit of claim 1 wherein the snap-close lids comprise a bottom portion that interacts with the paint storage containers and an upper portion connected to the bottom portion.

16. The kit of claim 15 wherein the snap-close lids comprise a bottom portion that interacts with the paint storage containers and an upper portion hinged to the bottom portion.

17. A kit comprising:
a storage container having
a top cover;
a bottom;
four side walls extending up from the bottom with the top cover rotatably connected to one of the side walls;
paint storage containers each having a snap-close liquid-tight lid;
an internal paint organizer with openings to receive the paint storage containers;

an internal tool container that stores painting, cutting, naildriving, and screwdriving hand tools comprising:
a hammer,
a putty knife,
a razor knife,
a jam saw,
paint rollers,
two paint trays,
2-ounce vials with pour caps,
1-ounce vials,
syringes,
3-ounce paint containers,
mess trays,
sponges,
paint brushes,
and
a water bottle;
and
an internal repair-material container that stores drywall, wood, and paint repair material comprising:
putty for patching,
a wood glue,
screws,
nails,
painter's tape,
drywall tape,
mesh patches,
stir sticks,
and
adhesive labels,
wherein the paint storage containers are taller than the vertical distance between the top cover and the bottom of the internal paint organizer such that closing the top cover snaps the liquid-tight lids closed to prevent paint leakage.

18. A method comprising:
supplying
a storage container having
a top cover;
a bottom;
four side walls extending up from the bottom with the top cover rotatably connected to one of the side walls;
paint storage containers each having a snap-close liquid-tight lid;
an internal paint organizer with openings to receive the paint storage containers;
an internal tool container;
and
an internal repair material container,
wherein the internal tool container stores painting, cutting, naildriving, and screwdriving hand tools,
wherein the internal repair material container stores drywall, wood, and paint repair material,
and
wherein the paint storage containers are taller than the vertical distance between the top cover and the bottom of the internal paint organizer such that closing the top cover snaps the liquid-tight lids closed to prevent paint leakage;
supplying a can of house paint having a color formula;
extracting an amount of house paint with a syringe;
placing the house paint into a paint storage container;
labeling the container with the color formula of the house paint;
placing the containers in internal paint organizer;
and
closing the top cover thereby snapping the liquid-tight lids closed to prevent paint leakage.

19. The method of claim 18 further comprising:
opening the top cover;
removing a paint container from the internal paint organizer;
unsnapping the liquid tight lid;
removing paint from the container;
applying paint to a substrate;
replacing the paint container into the internal paint organizer;
and
reclosing the top cover thereby resnapping the liquid-tight lids closed to prevent paint leakage.

* * * * *